United States Patent [19]

Bertram et al.

[11] Patent Number: 4,846,742

[45] Date of Patent: Jul. 11, 1989

[54] INTERNAL ROUTING OF HYDRAULIC FLUID FOR TRIM CYLINDERS

[75] Inventors: Francis Bertram, Malone; Douglas A. Kiesling, Oshkosh, both of Wis.

[73] Assignee: Brunswick Corporation, Skokie, Ill.

[21] Appl. No.: 222,724

[22] Filed: Jul. 21, 1988

[51] Int. Cl.[4] ..... B63H 5/12

[52] U.S. Cl. ..... 440/61

[58] Field of Search ..... 440/5, 57, 61; 114/280, 114/282

[56] References Cited

U.S. PATENT DOCUMENTS

| | | | |
|---|---|---|---|
| 3,534,703 | 10/1970 | Ekman | 440/61 |
| 3,587,511 | 6/1971 | Buddrus | 440/5 |
| 3,596,626 | 8/1971 | Buddrus | 440/5 |
| 3,673,978 | 7/1972 | Jeffery et al. | 440/61 |
| 3,718,110 | 2/1973 | Blanchard | 440/61 |
| 3,847,107 | 11/1974 | Buddrus | 440/5 |
| 3,915,111 | 10/1975 | Buddrus | 440/61 |

*Primary Examiner*—Joseph F. Peters, Jr.
*Assistant Examiner*—Jesûs D. Sotelo
*Attorney, Agent, or Firm*—Robert C. Curfiss

[57] ABSTRACT

A stern drive for a marine vessel is provided with a series of internal passageways that route the hydraulic fluid to the trim cylinders so that external hydraulic hoses can be eliminated.

10 Claims, 2 Drawing Sheets

INTERNAL ROUTING OF HYDRAULIC FLUID FOR TRIM CYLINDERS

BACKGROUND OF THE INVENTION

The present invention relates to a system for routing of hydraulic fluid to the trim cylinders of a marine stern drive. More specifically, the invention provides for the internal routing of the hydraulic fluid so that the hoses that are typically used to deliver hydraulic fluid to the cylinders can be eliminated.

In a typical marine stern drive, a pair of hydraulic cylinders are pivotally connected to the right and left hand side of the stern drive and are pivotally connected to a horizontal anchor pin so that actuation of the hydraulic cylinders results in the tilting of the stern drive about the horizontal axis.

A pair of hoses would be utilized for each hydraulic cylinder to deliver hydaulic fluid to each of the fluid chambers defined by the piston head in the cylinder. These hoses not only detracted from the design and styling of the stern drive but also were subject to breaking due to the constant movement from steering and trimming of the stern drive. The hoses also became stained by exhaust gases and picked up debris due to their exposed nature.

It is an object of the present invention to eliminate these hoses by providing for the internal routing of the hydraulic fluid to the trim cylinders.

SUMMARY OF THE PRESENT INVENTION

A stern drive for a marine vessel includes a system for internally routing the hydraulic fluid to the trim cylinders so that the external hydraulic lines may be eliminated.

In accordance with one aspect of the invention the system is provided with a pair of passageways in the gimbal housing that have inlet ports communicating with hydraulic lines and outlet ports.

In accordance with another aspect of the invention the lower swivel pin for the stern drive includes a pair of passageways that have inlet ports communicating with the outlet ports of the gimbal housing passageways and a pair of outlet ports.

In accordance with still another aspect of the invention the anchor pin of the stern drive is provided with a pair of passageways that have inlets communicating with the outlet ports of the swivel pin passageways and outlet ports that communicate with the hydraulic cylinders.

Thus the hydraulic fluid can be routed to the trim cylinders through a series of internal passageways which eliminates the need for any external hoses.

BRIEF DESCRIPTION OF THE DRAWINGS

The drawings illustrated the best mode presently contemplated of carrying out the invention.

DETAILED DESCRIPTION OF THE PREFERRED EMBODIMENT

Figure 1:
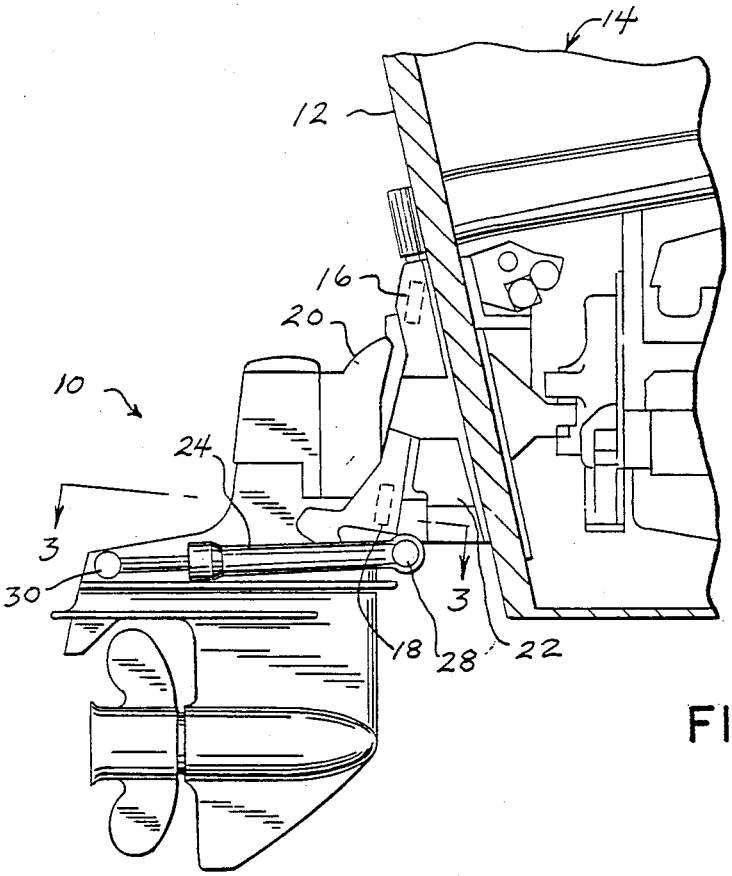
FIG. 1 is a side cross sectional view of a marine stern drive incorporating the hydraulic system of the present invention.
Figure 2:
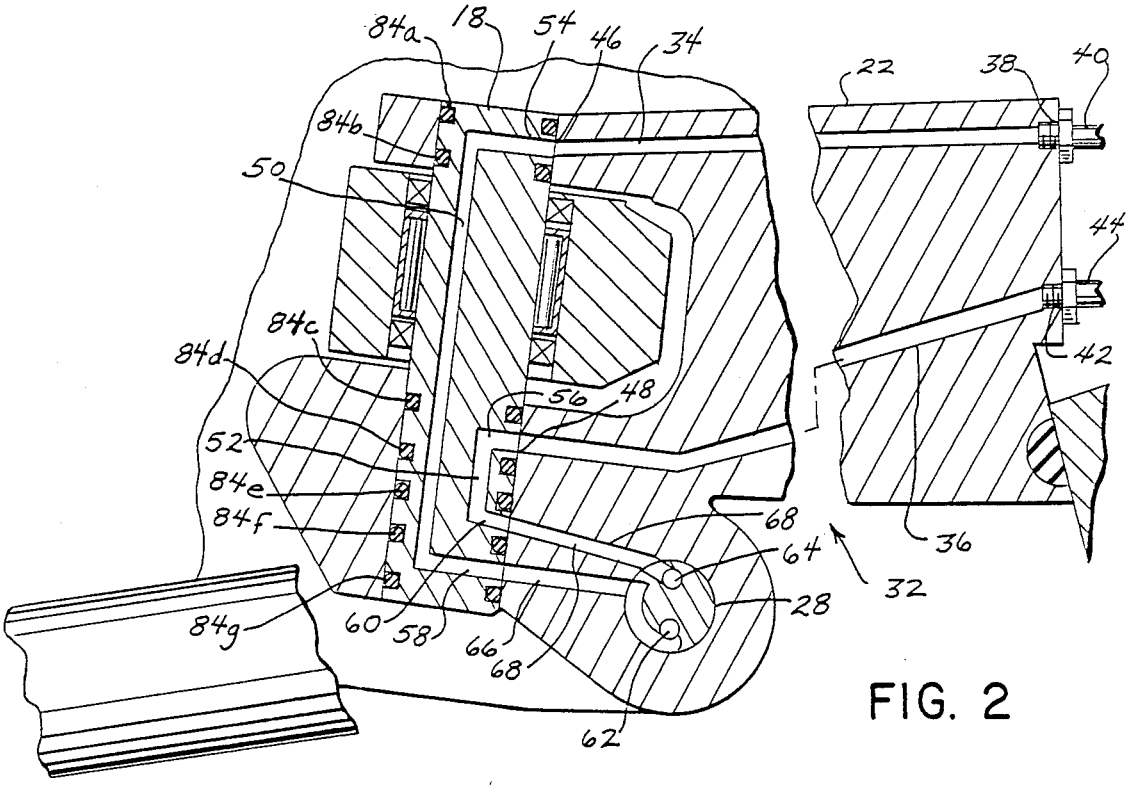
FIG. 2 is a sectional view along the line 2—2 of FIG. 3.
Figure 3:
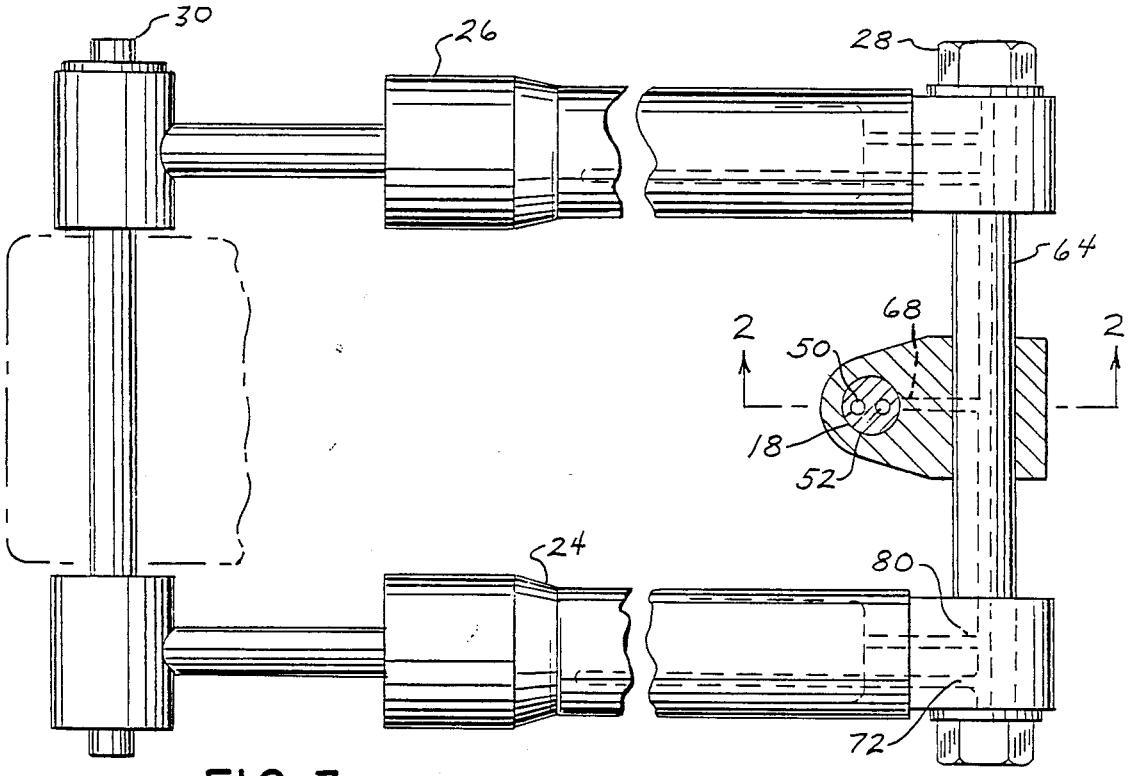
FIG. 3 is a sectional view along the line 3—3 of FIG. 1.
Figure 4:
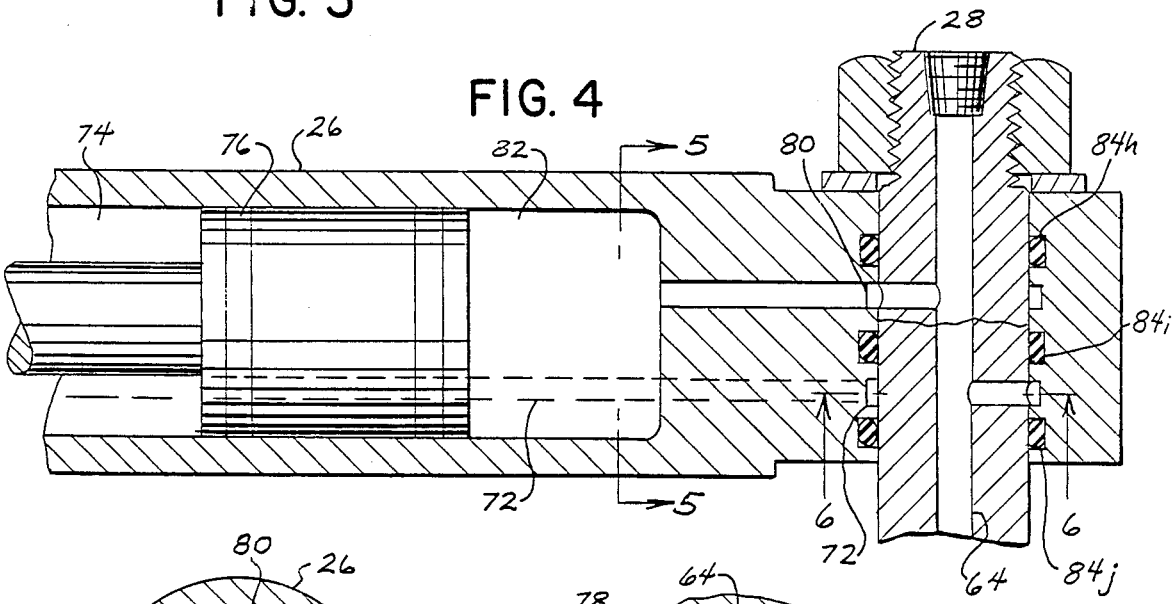
FIG. 4 is a top cross sectional view of a trim cylinder and anchor pin.
Figure 5:
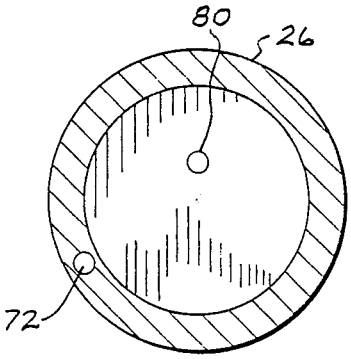
FIG. 5 is a sectional view along the line 5—5 of FIG. 4.

As shown in FIG. 1 a marine stern drive 10 is mounted to and extends from the stern 12 of a marine vessel 14. Stern drive 10 is mounted for pivotal steering movement about a vertical axis by means of upper and lower swivel pins 16 and 18. The stern drive also includes the typical bell housing 20 and gimbal housing 22. The stern drive is mounted for pivotal movement about a horizontal axis by means of hydraulic cylinders 24 and 26 mounted on the right and left hand side of stern drive 10 by means of a forward anchor pin 28 and a rear anchor pin 30. This pivotal movement of stern drive 10 about the horizontal axis defined by anchor pin 28 allows stern drive 10 to be trimmed for proper operation of marine vessel 14.

As seen in FIG. 2 through 6, pressurized hydraulic fluid is provided to hydraulic cylinders 24 and 26 by means of an internal routing system 32. Routing system 32 includes a first gimbal housing passageway 34 and a second gimbal housing passageway 36 bored through gimbal housing 22. Passageway 34 is provided with an inlet port 38 that communicates with an interior hydraulic line 40 located on the inside of marine vessel 14 and providing hydraulic fluid from a trim pump (not shown). Similarly passageway 36 is provided with a port 42 that communicates with an interior hydraulic line 44 connected to the trim pump. Passageway 34 is also provided with an outlet port 46 and passageway 36 is provided with an outlet port 48.

Routing system 32 further includes a first lower swivel pin passageway 50 and a second swivel pin passageway 52. First swivel pin passageway 50 has an inlet port 54 communicating with outlet port 46 of first gimbal housing passageway 34. Similarly second swivel pin passageway 52 has an inlet port 56 communicating with outlet port 48 of second gimbal housing passageway 36. First swivel pin passageway 50 is provided with an outlet port 58 and second swivel pin passageway 50 is provided with an outlet port 60.

Internal routing system 32 is further provided with a first anchor pin passageway 62 and a second anchor pin passageway 64 that extend axially outwardly from a pair of inlet ports 66 and 68. Inlet port 66 communicates with outlet port 58 of first swivel pin passageway 50 and inlet port 68 communicates with outlet port 60 of second swivel pin passageway 52.

At its axial distal end first anchor pin passageway 62 has an outlet port 70 that communicates with cylinder port 72. Hydraulic fluid supplied to cylinder port 72 is communicated to the fluid chamber 74 on the rod side of piston head 76. Similarly the axial distal end of second anchor pin passageway 64 is provided with an outlet port 78 that communicates with cylinder port 80 to provide hydraulic fluid to fluid chamber 82 on the head side of hydraulic cylinder 26.

Figure 6:
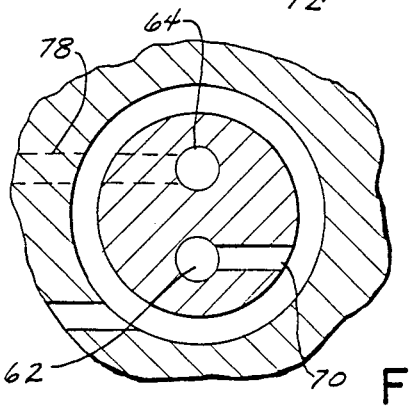
FIG. 6 is a sectional view along the line 6—6 of FIG. 4.

Since there is rotational movement about both swivel pin 18 and anchor pin 28, the inlet and outlet ports associated with the passageways in the swivel pin and anchor pin are in the form of circumferential grooves such as shown in FIG. 6 so that the communication may be maintained during pivotal movement. Each of the circumferential grooves is provided with a seal 84*a* through 84j to prevent the leakage of hydraulic fluid from the grooves.

While the structure and operation of only a single hydraulic cylinder has been shown, it should be understood that the pivotal movement of stern drive 10 about the horizontal axis is accomplished through the use of a pair of hydraulic cylinders and therefore, anchor pin passageways 62 and 64 extend axially outwardly in both directions from substantially centrally located inlet ports 66 and 68. The present invention thus provides a series of internal passageways that route the hydraulic fluid to the trim cylinders for the stern drive. Thus, the external hoses typically associated with the hydraulic system can be eliminated.

It is recognized that various alternatives and modifications are possible in the scope of the appended claims.

We claim:

1. In a stern drive for a marine vessel in which the stern drive may be pivoted about a vertical axis defined by upper and lower swivel pins with the lower swivel pin disposed within a gimbal housing and about a horizontal axis by the use of a hydraulic cylinder having a piston head and rod defining a pair of fluid chambers and operatively connected between the stern drive and an anchor pin, a system for internally routing the hydraulic fluid to the cylinder so that external hydraulic lines may be eliminated, said system comprising:

means defining a first passageway in the gimbal housing with said first passageway having an inlet port communicating with an hydraulic line and an outlet port, means defining a first passageway in the lower swivel pin, with said passageway having an inlet port communicating with said outlet port of said first gimbal housing passageway and an outlet port, means defining a first passageway in the anchor pin with said passageway having an inlet port communicating with said outlet port of said first swivel pin passageway and an outlet port communicating with a first port in the hydraulic cylinder so that hydraulic fluid may be supplied to or exhausted from one of the cylinder chambers, means defining a second passageway in the gimbal housing with said second passageway having an inlet port communicating with an hydraulic line and an outlet port, means defining a second passageway in the lower swivel pin, with said passageway having an inlet port communicating with said outlet port of said second gimbal housing passageway and an outlet port, and means defining a second passageway in the anchor pin with said passageway having an inlet port communicating with said outlet port of said second swivel pin passageway and an outlet port communicating with a second port in the hydraulic cylinder so that hydraulic fluid may be supplied or exhausted from the other of the cylinder chambers.

2. The hydraulic system defined in claim 1 wherein said inlet port for said first lower swivel pin passageway comprises a circumferential groove communicating with a first axial passageway portion of said first lower swivel passageway in the swivel pin and having seals disposed on each side of said groove.

3. The hydraulic system defined in claim 1 wherein said outlet port for said first lower swivel pin passageway comprises a circumferential groove communicating with a first axial passageway portion of said first lower swivel pin passageway in the swivel pin and having seals disposed on each side of said groove.

4. The hydraulic system defined in claim 1 wherein said inlet port for said second lower swivel pin passageway comprises a circumferential groove communicating with a second axial passageway portion of said second lower swivel pin passageway in the swivel pin and having deals disposed on each side of said groove.

5. The hydraulic system defined in claim 1 wherein said outlet port for said second lower swivel pin passageway comprises a circumferential groove communicating with a second axial passageway portion of said second lower swivel pin passageway in the swivel pin and having seals disposed on each side of said groove.

6. The hydraulic system defined in claim 1 wherein said inlet port for said first anchor pin passageway comprises a circumferential groove communicating with a first axial passageway portion of said first anchor pin passageway in the anchor pin and having seals disposed on each side of said groove.

7. The hydraulic system defined in claim 1 wherein said outlet port for said first anchor pin passageway comprises a circumferential groove communicating with a first axial passageway portion of said first anchor pin passageway in the anchor pin and having seals disposed on each side of said groove.

8. The hydraulic system defined in claim 1 wherein said inlet port for said second anchor pin passageway comprises a circumferential groove communicating with a second axial passageway in the anchor pin and having seals disposed on each side of said groove.

9. The hydraulic system defined in claim 1 wherein said outlet port for for said second anchor pin passageway comprises a circumferential groove communicating with a second axial passageway portion of said second anchor pin passageway in the anchor pin and having seals disposed on each side of said groove.

10. The hydraulic system defined in claim 1 wherein a pair of hydraulic cylinders are utilized with one disposed on the left of the stern drive and one disposed on the right of the stern drive and said inlet ports for said anchor pin passageways are substantially centrally located in said anchor pin and said first and second anchor pin passageways extend axially outwardly to a pair of first and second anchor pin passageway outlet ports.

* * * * *